United States Patent [19]

Dimino

[11] 4,281,794

[45] Aug. 4, 1981

[54] FOUNTAIN SYSTEM INCLUDING A PLURALITY OF WOODEN BARRELS

[76] Inventor: William Dimino, 12226 ½ Montana Ave., Los Angeles, Calif. 90049

[21] Appl. No.: 186,459

[22] Filed: Sep. 12, 1980

[51] Int. Cl.[3] ..... B05B 17/08

[52] U.S. Cl. ..... 239/20; 239/23

[58] Field of Search ..... 239/20, 23, 16, 17, 239/18, 22; 47/38, 39, 16, 14, 34.12, 1.2; 137/575

[56] References Cited

U.S. PATENT DOCUMENTS

| | | | |
|---|---|---|---|
| 2,860,916 | 11/1958 | Hynko | 239/23 |
| 3,451,622 | 6/1969 | Forney | 239/20 |

*Primary Examiner*—James B. Marbert

*Attorney, Agent, or Firm*—W. Edward Johansen

[57] ABSTRACT

The present invention is a fountain system which includes a plurality of wooden barrels. The fountain system includes a first wooden barrel which is disposed at a first level and which has an outlet for water and one half of a second barrel which is disposed at a second level, which is below the first level, so that the water from the outlet of the first wooden barrel may flow into the second wooden barrel. The fountain system also includes a pump which pumps the water from the second wooden barrel to the first wooden barrel, a tubular conduit which is fluidly coupled to the pump and a dispersal nozel which includes a flat plate and a hollow truncated-member which is fluidly coupled to the outlet of the first wooden barrel which is formed by a plurality of bores in the sidewall thereof and which is also fluidly coupled to the tubular conduit. The fountain system further includes one half of a third wooden barrel which is disposed at a third level which is intermediate the first and second levels so that water from the output of the first wooden barrels flows into the third wooden barrel, which also has an outlet, and a flow guide which guides the flow of water from the outlet of the third wooden barrel, which is formed by a plurality of bores in the sidewall thereof, to the second wooden barrel. The second and third wooden barrels may be covered with screens in order to minimize splashing. The third wooden barrel has an apparatus for controlling the overflow of water therein.

2 Claims, 5 Drawing Figures

FOUNTAIN SYSTEM INCLUDING A PLURALITY OF WOODEN BARRELS

BACKGROUND OF THE INVENTION

1. Field of the Invention

The present invention relates to a fountain system which incorporates a plurality of wooden barrels and more particularly to a fountain system wherein the output of each wooden barrel is such that the water appears to spring from a natural leak in the barrel.

2. Description of the Prior Art

U.S. Pat. No. 4,006,559, entitled Self-Irrigating Display Rack for Potted Plants, issued to Richard A. Carlyon, Jr. on Feb. 8, 1977, teaches a diplay rack for potted plants which includes a bucket-like base forming a reservoir for irrigating water, an elongated upright tubular member which is supported on the base and which extends upward therefrom, a plurality of display dishes which are mounted in a spaced tiered relationship on the tubular member over the reservoir. Each of the display dishes has a bottom and an open top. The display also includes a pipeline which extends upward through the tubular member from the reservoir to the upper end of the tubular member and a pump which is mounted in the reservoir and which has an outlet which is coupled to the pipeline for pumping the irrigating water from the reservoir through the pipeline. The outlet which is mounted on the pipeline at the top of the tubular member to direct water out of the pipeline into the interior of the tubular member to be returned to the reservoir through the tubular member. The tubular member has first openings each of which is directly over each of the dishes which are supported thereon and a corresponding plurality of annular plug members which are mounted within the tubular which are supported thereon and a corresponding plurality of annular plug members which are mounted within the tubular member coaxially aligned with the pipeline and filling the space between the pipeline and the inner wall of the tubular member. The annular plug member is respectively interposed the first and second openings in the tubular member to divert the irrigating water in the tubular member out through the dishes, with the water being returned to the tubular member through the second openings therein after reaching a predetermined level in the individual display dish so as to cause the display dishes from the top of the display rack down to the bottom thereof to be sequentially filled with irrigating water.

U.S. Pat. No. 3,451,622, entitled Decorator Fountains, issued to Arthur Forney on June 24, 1969, teaches a decorator fountain which can be used for homes, lawns, patios, business institutions, offices and the like and which is mounted on casters so that it can be moved from one location to another in a simple manner. The fountain has its own built-in water reservoir and recirculating pump. The water reservoir has an automatic replacement for water which is lost due to evaporation. The fountain has a three-way electric switch which is light without pump, pump without light and pump and light combined.

Wooden barrels have also been used to form fountains by using metal pipes which are placed in a hole in the barrel so that water may flow out of one barrel into another barrel which is disposed at a lower level. The use of pipe detracts from the otherwise very natural setting of the wooden barrels.

SUMMARY OF THE INVENTION

From the foregoing factors and conditions which are characteristic of the prior art it is the primary object of the present invention to provide a fountain system which incorporates the use of a plurality of wooden barrels and which does not require the use of pipe to connect one barrel to a lower barrel.

It is still another object of the present invention to provide a fountain system using a plurality of barrels which allows water to flow from each of the barrel as though the barrel is spring a leak.

In accordance with an embodiment of the present invention a fountain system which includes a plurality of wooden barrels has been described. The fountain system includes a first wooden barrel having an outlet from which water flows into a second wooden barrel through a third wooden barrel which also has an outlet. The fountain system also includes a pump which recirculates the water from the second wooden barrel back to the first wooden barrel. The fountain system further includes a dispersal nozel which is fluidly coupled to the pump by a tubular conduit and to the outlet of the first wooden barrel and a flow guide which is fluidly coupled to the outlet of the third wooden barrel so that water may flow into the second wooden barrel from the first wooden barrel. The fountain system still further includes an overflow tube for maintaining the water level.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
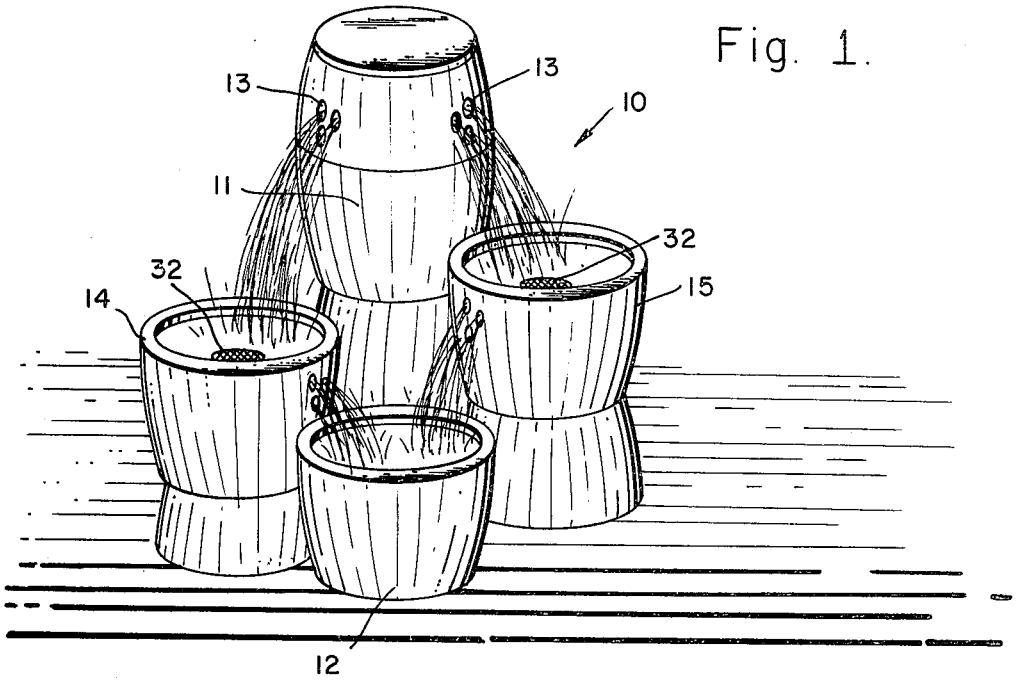
FIG. 1 is a perspective drawing of a fountain system including a plurality of wooden barrels which has been constructed in accordance with the principles of the present invention.

In order to best understand the present invention it is necessary to refer to the following description of its preferred embodiment in conjunction with the accompanying drawing. Referring to FIG. 1 a fountain system 10 includes a first wooden barrel 11 which is disposed at a first level and one half of a second barrel 12 which is disposed at a second level which is below the first level of the first wooden barrel 11 so that water from an outlet 13 of the first wooden barrel 11 may flow into the second wooden barrel 12. The fountain system 10 also has one half of a third wooden barrel 14 which is disposed at a third level which is intermediate to the first and second levels and one of a fourth wooden barrel 15 which is disposed at fourth level which is also intermediate to the first and second levels. The third wooden barrel 14 has an outlet 16 and the fourth wooden barrel 15 has an outlet 17 so that water may flow into the second wooden barrel 12 from the first wooden barrel 11 through the third and fourth wooden barrels 14 and 15.

The outlets 13, 16 and 17 of the first, third and fourth wooden barrels 11, 14 and 15 are formed by a plurality of bores in the sidewall of the first, third and fourth wooden barrels 11, 14 and 15 so that water appears to be leaking from the wooden barrels thereby providing a natural-looking flow of water.

Figure 2:
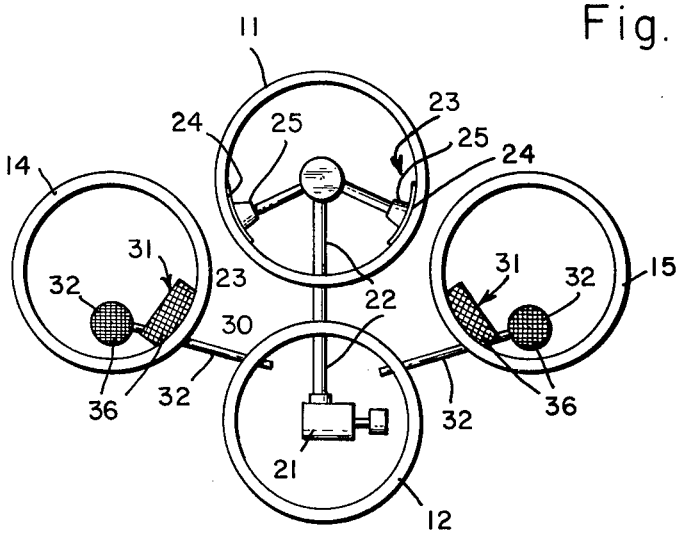
FIG. 2 is a plan view of the fountain system of FIG. 1.

Referring to FIG. 2 the fountain system also includes a pump 21 which may be disposed in the second wooden barrel 12 and which recirculates the water from the second wooden barrel 12 back to the first wooden barrel 11 through a tubular conduit 22. The tubular conduit 22 is disposed in both the first and second wooden barrels 11 and 12. The fountain system further includes a dispersal nozel 23 which is fluidly coupled to the pump 21 through the tubular conduit 22 and to the outlet 13 of the first wooden barrel 11.

Figure 4:
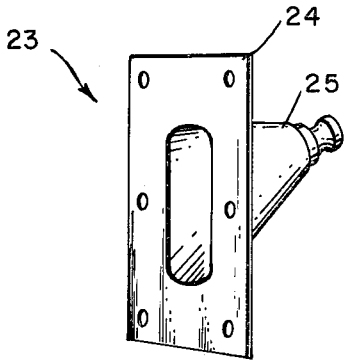
FIG. 4 is a perspective drawing of a dispersal nozel of the fountain system of FIG. 1.
Figure 3:
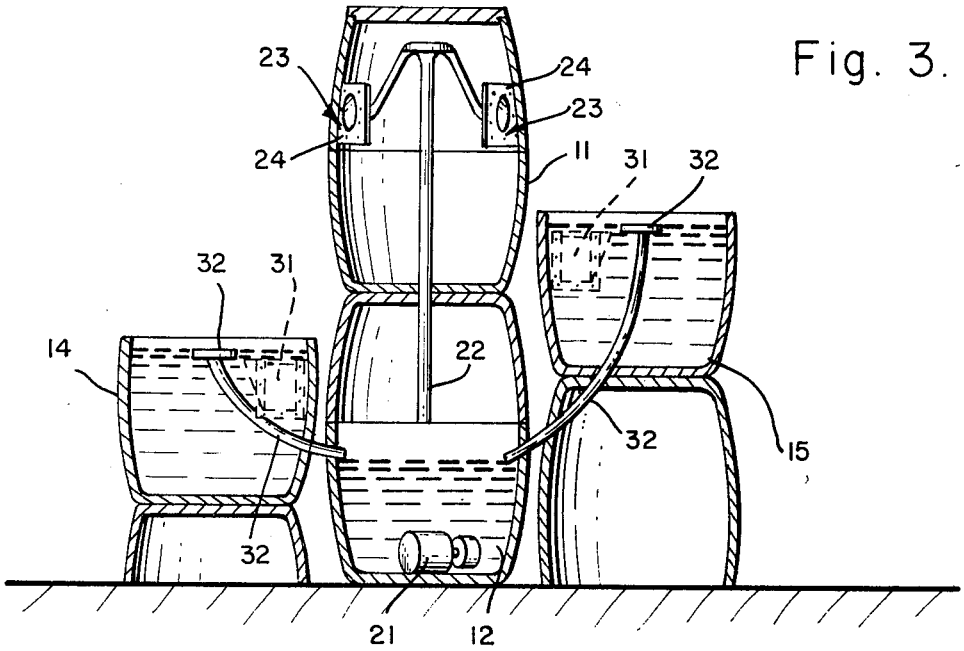
FIG. 3 is an elevational cross-sectional view of the fountain system of FIG. 1.

Referring now to FIG. 3 in conjunction with FIG. 2 and FIG. 4 the dispersal nozel 23 includes a flat plate 24, which is disposed adjacent to the inner sidewall of the first wooden barrel 11, and a hollow truncated-conical member 25, which is fluidly coupled to the tubular conduit 22 and to the outlet 13 of the first wooden barrel 11.

Figure 5:
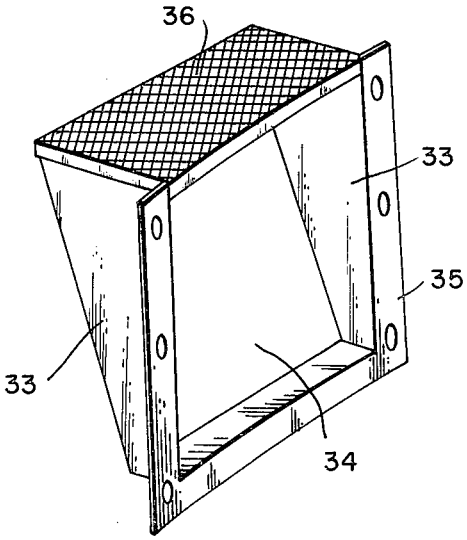
FIG. 5 is a perspective drawing of a flow guide of the fountain system of FIG. 1.

Referring now to FIG. 5 in conjunction with FIG. 2 and FIG. 3 the fountain system 10 still further includes a flow guide 31 which is disposed in the third wooden barrel 14 and an overflow tube 32 which controls water level in the third wooden barrel 14. The flow guide includes a pair of parallel trapazoidal plates 33, a top plate 34 which is coupled to the peripheral edge of each of the parallel trapazoidal plates 33 and a flange 35 which is coupled to the bottom edge of each of the parallel trapazoidal plates 33. The flow guide is fluidly coupled to the outlet 16 of the third wooden barrel 14. The overflow tube 32 is fluidly coupled to the second wooden barrel 12. The fourth wooden barrel 15 also has a flow guide 31 and an overflow tube 32. A screen 36 may be added in order to reduce the splashing of the water.

From the foregoing it can be seen that a fountain system has been described. The fountain system incorporates a plurality of wooden barrels in a scenic setting. The arrangement of the wooden barrels is modular. Therefore any combination of wooden barrels using dispersal nozels in conjunction with pumps and flow guide is contemplated by the present invention. Among the primary advantages are that the fountain system is modular allowing a a wide variety of combination of full wooden barrels and fractions of wooden barrels to be used and that the character of the fountain system is such its natural qualities are enhanced as the fountain system ages in that a variety of plant life begins to grow.

It should therefore be noted that the combination of wooden barrels, distances of and between figures are not to be considered significant. The following disclosure and showing in the drawing are to be considered only as an illustration of the present invention. The invention will be set forth with particularity in the appended claims.

What is claimed is:

1. A fountain system comprising:

a. a first wooden barrel which is disposed at a first level, said first wooden barrel having an outlet for water;

b. one half of a second wooden barrel which is disposed at a second level which is below the first level of said first wooden barrel so that water from said outlet of said first wooden barrel may flow into said second wooden barrel;

c. pumping means for pumping water from said second wooden barrel to said first wooden barrel;

d. a tubular conduit which is fluidly coupled to said pumping means;

e. a dispersal nozzle including a flat plate and a hollow truncated-conical member which is fluidly coupled to said tubular conduit and which is also fluidly coupled to said outlet, which is formed by a plurality of bores in the sidewall of said first wooden barrel; where said pumping means recirculate water from said second wooden barrel to said first wooden barrel;

f. one half of a third wooden barrel which is disposed at a third level which is intermediate the first level of said first wooden barrel and the second level of said second wooden barrel and which is also disposed so that water from said output of said first wooden barrel flows into said third wooden barrel, said third wooden barrel having an outlet for water; and g. out-flowing means for allowing water to out-flow from said third wooden barrel into said second wooden barrel, said out-flowing means fluidly coupled to said output of said third wooden barrel, said flow guide including a pair of parallel trapezoidal plates, a top plate which is coupled to the peripheral edge of each of said pair of parallel trapezoidal plates and a flange which is coupled to the bottom edge of each of said pair of parallel trapezoidal plates, said flow guide is fluidly coupled to said outlet, which is formed by a plurality of bores in the sidewall of said third wooden barrel, and overflow controlling means for controlling the water level in said third wooden barrel so that the water does not overflow therefrom, said overflow controlling means being fluidly coupled to said second wooden barrel.

2. A fountain system according to claim 1 wherein said fountain system further comprises a plurality of screens, each of which covers each of said second and third wooden barrels in order to reduce the amount of splashing as the water flows into said second and third wooden barrels.

* * * * *